US009459037B2

(12) United States Patent
Wood et al.

(10) Patent No.: US 9,459,037 B2
(45) Date of Patent: Oct. 4, 2016

(54) PORTABLE REFRIGERATION UNIT FOR PALLETIZED PRODUCT

(71) Applicant: Hussmann Corporation, Bridgeton, MO (US)

(72) Inventors: Diego Wood, Corona, CA (US); Timothy Mandelcorn, Rancho Cucamonga, CA (US); Steve W. Downs, Banning, CA (US)

(73) Assignee: Hussmann Corporation, Bridgeton, MO (US)

( * ) Notice: Subject to any disclaimer, the term of this patent is extended or adjusted under 35 U.S.C. 154(b) by 242 days.

(21) Appl. No.: 13/797,432

(22) Filed: Mar. 12, 2013

(65) Prior Publication Data

US 2014/0260365 A1 Sep. 18, 2014

(51) Int. Cl.

| | |
|---|---|
| ***F25D 3/08*** | (2006.01) |
| ***F25D 15/00*** | (2006.01) |
| ***F25D 19/00*** | (2006.01) |
| *F25D 17/06* | (2006.01) |

(52) U.S. Cl.

CPC ..... *F25D 15/00* (2013.01); *F25D 19/00* (2013.01); *F25D 17/06* (2013.01); *F25D 2317/0672* (2013.01); *F25D 2400/12* (2013.01)

(58) Field of Classification Search

CPC ..... F25D 15/00; F25D 17/06; F25D 19/00; F25D 2317/0672; F25D 2400/12; A47F 3/04

USPC ..... 62/371, 530, 448, 407, 89, 259.1, 372

See application file for complete search history.

(56) References Cited

U.S. PATENT DOCUMENTS

| | | | | |
|---|---|---|---|---|
| 3,633,381 | A | 1/1972 | Haaf et al. | |
| 3,690,118 | A * | 9/1972 | Rainwater | 62/250 |
| 3,848,426 | A | 11/1974 | Whitney | |
| 4,991,402 | A | 2/1991 | Saia, III | |
| 5,028,443 | A | 7/1991 | Wade | |
| 5,101,643 | A | 4/1992 | Hicke | |
| 5,121,739 | A * | 6/1992 | Barker | F02N 19/02 123/142.5 R |
| 5,125,237 | A | 6/1992 | Saia, III et al. | |
| 5,267,448 | A | 12/1993 | Van Den Heuvel | |
| 5,363,670 | A | 11/1994 | Bartilucci | |
| 5,671,609 | A | 9/1997 | Lionetti | |
| 5,768,907 | A * | 6/1998 | Lee | 62/293 |
| 5,791,150 | A * | 8/1998 | Bosher et al. | 62/62 |
| 5,996,366 | A | 12/1999 | Renard | |
| 6,227,146 | B1 * | 5/2001 | Gabriel et al. | 119/419 |
| 6,578,939 | B1 * | 6/2003 | Mayer | A47B 88/044 312/334.5 |
| 6,615,908 | B1 | 9/2003 | Bosher et al. | |
| 7,178,356 | B1 | 2/2007 | Lingelback et al. | |

(Continued)

*Primary Examiner* — Len Tran
*Assistant Examiner* — Ana Vazquez
(74) *Attorney, Agent, or Firm* — Michael Best & Friedrich LLP

(57) ABSTRACT

A portable refrigeration unit for cooling palletized products disposed within a racking system. The portable refrigeration unit includes a case and a refrigeration system disposed in the case. The case includes a bottom wall, a top wall, and side walls. The case is configured to be supported by the racking system above a pallet of products positioned below the case. The refrigeration system includes a compressor, a condenser, an expansion device, and an evaporator connected in series. The refrigeration system includes an evaporator fan configured to draw in air from below the case, move the air through the evaporator, and then discharge the air through the bottom wall such that the cooled air passes over the products below the case to cool the products below the case.

23 Claims, 8 Drawing Sheets

(56) References Cited

U.S. PATENT DOCUMENTS

| | | | | |
|---|---|---|---|---|
| 2004/0035553 | A1 | 2/2004 | Boscher et al. | |
| 2004/0100770 | A1 | 5/2004 | Chu et al. | |
| 2006/0207284 | A1 | 9/2006 | Lehman et al. | |
| 2009/0183808 | A1* | 7/2009 | Sappington et al. | 150/159 |
| 2011/0058923 | A1 | 3/2011 | Campbell et al. | |
| 2011/0063778 | A1* | 3/2011 | Brouillard | 361/678 |
| 2011/0107784 | A1 | 5/2011 | Tippmann et al. | |
| 2011/0197612 | A1 | 8/2011 | Campbell et al. | |
| 2013/0111936 | A1* | 5/2013 | Olson | 62/127 |
| 2013/0133357 | A1* | 5/2013 | Wei | 62/419 |

* cited by examiner

PORTABLE REFRIGERATION UNIT FOR PALLETIZED PRODUCT

BACKGROUND

The present invention relates to a portable refrigeration unit for cooling palletized product.

Generally, palletized products are cooled by locating the pallet of products in a refrigerated warehouse or within a storage cooler. These refrigeration options are limited in that they may not provide a satisfactory solution for palletized products where the volume of palletized products requiring cooling is low or where the nature of such palletized products is transient such that the space or expense of a refrigerated warehouse or a storage cooler would not be justified.

In addition, refrigerated warehouses or storage coolers do not provide a desirable marketing solution that allows end consumers access to palletized products from a comfortable, room temperature retail setting (e.g., a grocery store). As a result, retailers typically will either have the consumers shop from the inside of a storage cooler (e.g., a beer cooler) or the retailer will individually remove all of the products from the shipping pallet and place them in refrigerated merchandising display cases. Although this merchandising of product provides visual appeal, it is labor intensive and adds to the overall expense of operating such a store.

SUMMARY

The present invention provides a portable refrigeration unit that allows a cooling option for individual palletized product maintained within a racking system. For example, in a shipping warehouse setting, select pallets requiring refrigeration can be accommodated without the need for a separate refrigerated warehouse or storage cooler. As another example, in a retail setting such as a grocery store or warehouse grocery store, select pallets within a racking system can be refrigerated while providing consumer access to the refrigerated products on the pallet.

In one embodiment, the invention provides a portable refrigeration unit for cooling palletized products disposed within a racking system. The portable refrigeration unit includes a case and a refrigeration system disposed in the case. The case includes a bottom wall, a top wall, and side walls. The case is configured to be supported by the racking system above a pallet of products positioned below the case. The refrigeration system includes a compressor, a condenser, an expansion device, and an evaporator connected in series. The refrigeration system includes an evaporator fan configured to draw in air from below the case, move the air through the evaporator, and then discharge the air through the bottom wall such that the cooled air passes over the products below the case to cool the products below the case.

In another embodiment, the invention provides a portable refrigeration system including a racking system, a pallet of products to be cooled, and the portable refrigeration unit as described above. The racking system supported on a floor. The pallet of products is disposed within the racking system.

In yet another embodiment, the invention provides a method of cooling palletized products disposed within a racking system. The method includes providing a racking system, supporting the racking system on a floor, placing a pallet of product to be cooled on the floor within the racking system, positioning a portable refrigeration unit above the pallet of product to be cooled, supporting the portable refrigeration unit with the racking system, discharging cooled air from the portable refrigeration unit into a space below the portable refrigeration unit, and passing the cooled air over the products to cool the products.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
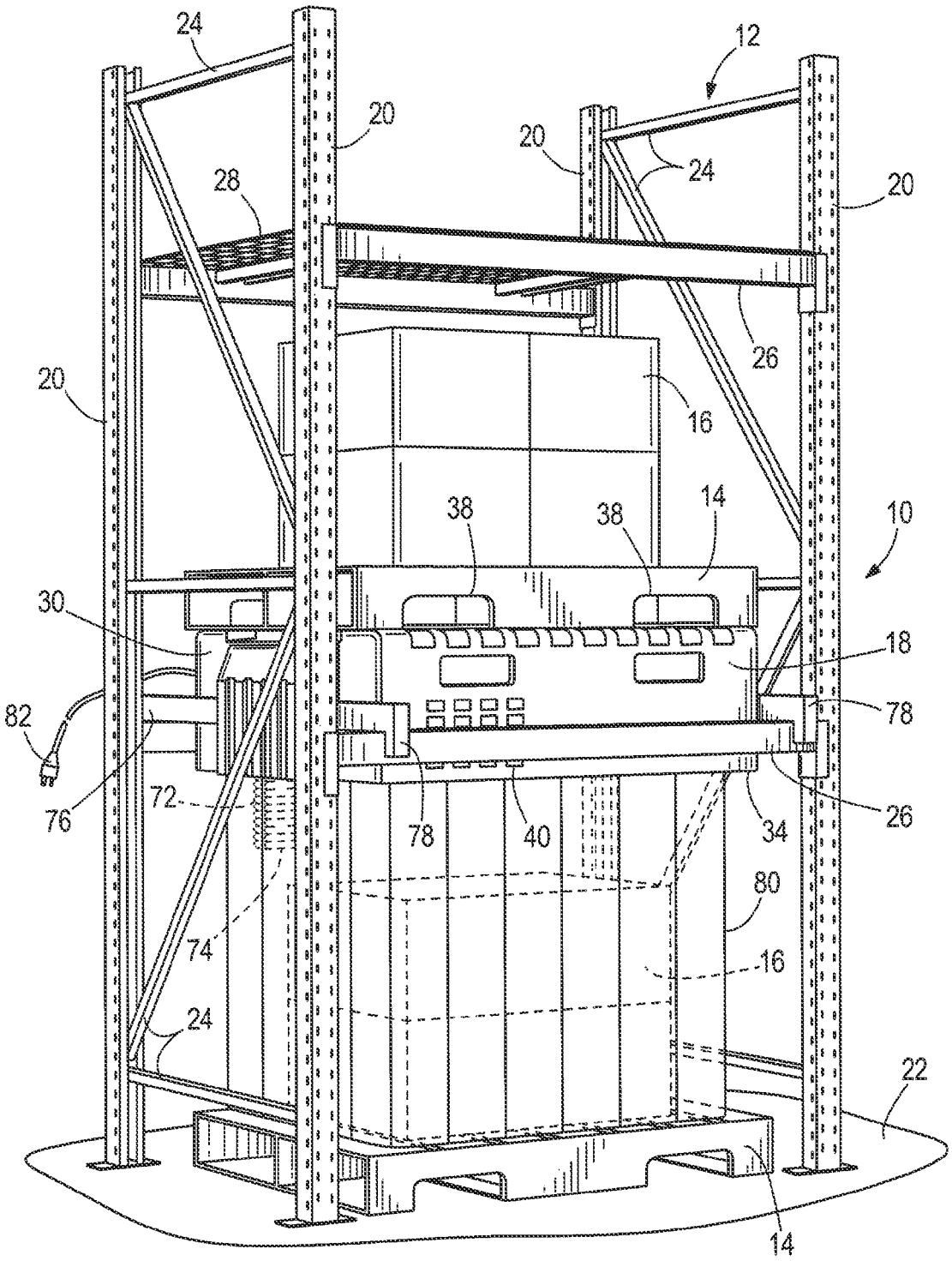
FIG. 1 is a perspective view of one construction of a portable refrigeration system according to the invention.

FIG. 1 illustrates a portable refrigeration system 10 according to one construction of the invention. The portable refrigeration system 10 includes a racking system 12, a pallet 14 of products 16 to be cooled, and a portable refrigeration unit 18.

The racking system 12 of FIG. 1 is typically used in shipping warehouses as well as warehouse-style grocery stores. The racking system 12 includes four vertical supports 20 supported by the floor 22 and defining a rectangular perimeter. Each vertical support 20 is a metal tubular structure that is also rectangular in cross section. Each vertical support 20 includes regularly-spaced cutouts along its length. Additional supports 24 are connected between the side pairs of vertical supports 20.

The racking system 12 also includes a pair of front horizontal supports 26 coupling a front pair of the vertical supports 20 and a pair of rear horizontal supports 26 coupling a rear pair of the vertical supports 20. Each horizontal support 26 is a metal tubular structure that is rectangular in cross section. Each end of the horizontal supports 26 includes one or more mating hooks (not shown) that connect to a corresponding vertical support 20 by passing the mating hook(s) through a corresponding cutout(s) and moving the horizontal support 26 downward to lock the mating hook(s) into the cutout(s). In this manner, the height of the horizontal support 26 can be adjusted by passing the mating hook(s) through different corresponding cutout(s). The top pair of horizontal supports 26 supports a steel wireframe shelf 28 for supporting palletized product 16.

Figure 2:
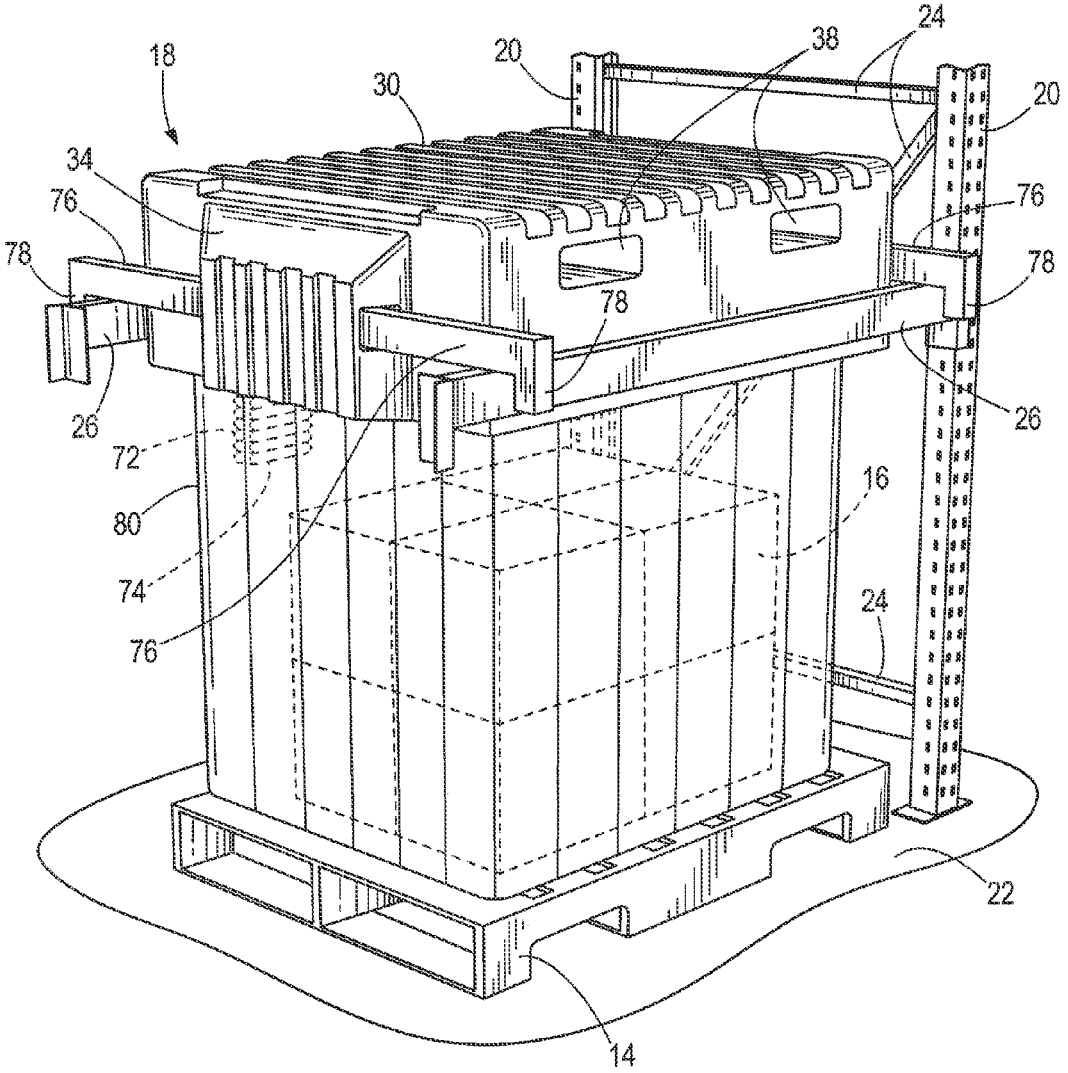
FIG. 2 is a perspective view of a portable refrigeration unit of the portable refrigeration assembly of FIG. 1.
Figure 4:
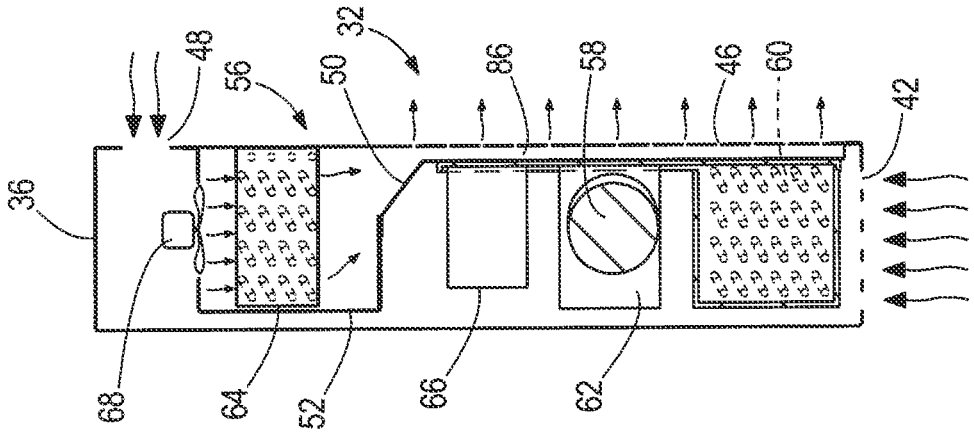
FIG. 4 is a cross-section view taken along line 4-4 in FIG. 3.
Figure 3:
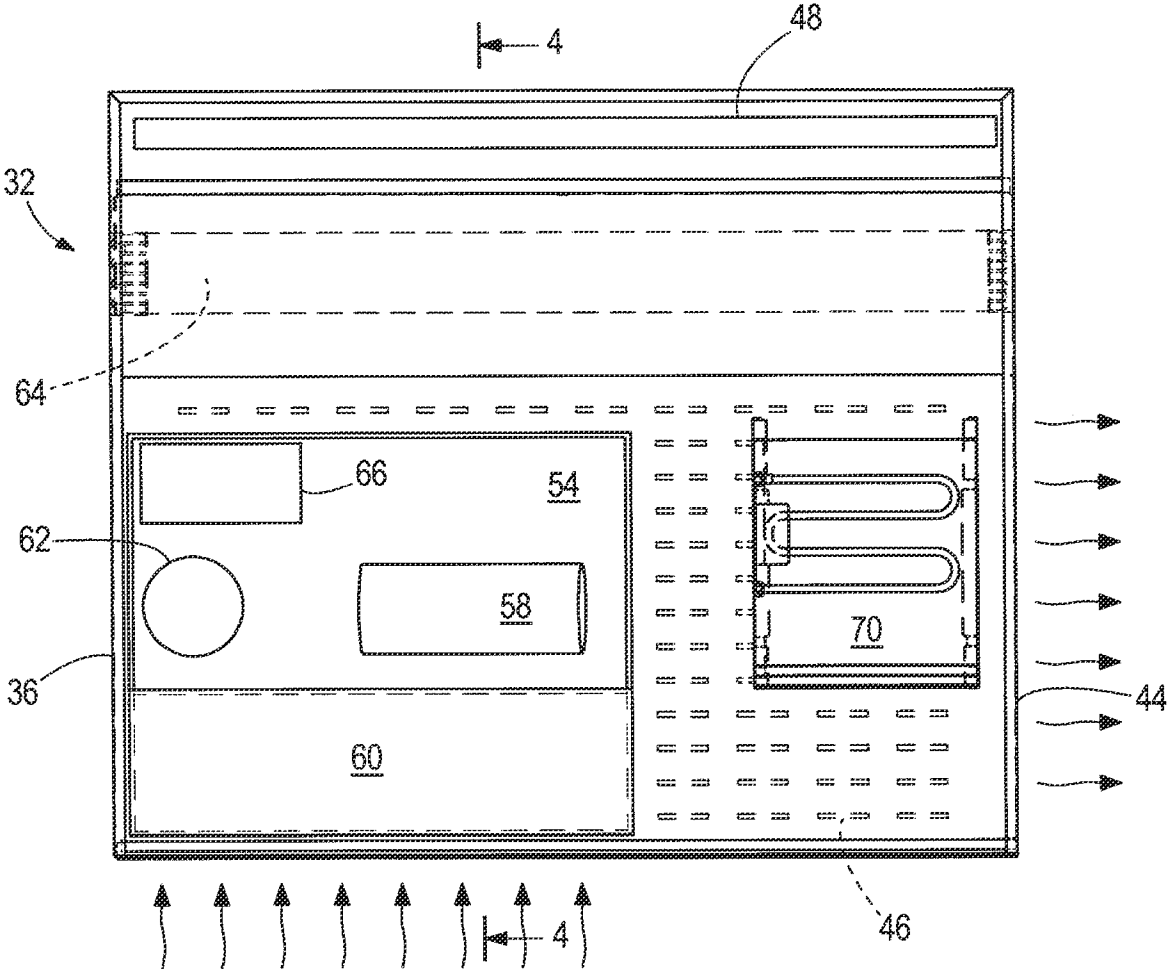
FIG. 3 is a top view of the portable refrigeration unit of FIG. 2 with a cover removed.

With further reference to FIG. 2, the pallet 14 is a standard shipping pallet including a wood structure having two side walls and a wood slats across the lengths of the top and bottom connecting the two side walls. The center area of the pallet 14 also includes supports at the ends and center. The pallet 14 can be picked up by forks of a forklift (not shown) by passing the forks through the openings on the ends of the pallet 14 or through the openings in the sides of the pallet 14. Products 16 are stacked on top of the pallet 14 and generally are arranged for the most efficient use of space for shipping purposes. The products 16 can include, for example, food products such as dairy, cheese, produce, and eggs, beverages such as wine and beer, flowers, pharmaceuticals, medication, medical equipment, military surplus, disaster relief or industrial materials.

The portable refrigeration unit 18 includes a case 30 and a refrigeration system 32 disposed inside the case 30. The case 30 is a rigid, rugged, and durable protective casing that includes cover 34 and a tray 36. The cover 34 includes a top wall and side walls. The top and side walls can be made from fiberglass or a thermoformed material. The top and side walls include exposed ribbing and geometric recesses for strength. The top and side walls are integrated with robust, radiused corners. The top wall includes a series of ribs and grooves that extend across the case 30 from the front to the back. The front wall includes two apertures 38 for receiving forks of a forklift for lifting the portable refrigeration unit 18 into position on the racking system 12. As shown in FIG. 1, the front wall includes perforations 40 for allowing the introduction of air into the case 30. The side wall also includes perforations (not shown) for allowing the discharge of air from the case 30.

The tray 36 is fastened to the cover 34 to form an enclosed space within the case 30 for housing the refrigeration system 32. The tray 36 is formed from metal (e.g., steel) and includes a bottom wall and side walls. The side walls of the tray 36 fit inside the sidewalls of the cover 34 when the cover 34 is assembled with the tray 36. As shown in FIGS. 3-6, the front wall includes front perforations 42 for allowing the introduction of air into the case 30. The side wall also includes side perforations 44 for allowing the discharge of air from the case 30. In addition, the bottom of the tray 36 includes bottom perforations 46 and a bottom aperture 48 adjacent the rear wall. The inside of the tray 36 is divided by a first divider 50 and a second divider 52. The cover 34 contacts the second divider 52 when the cover 34 is assembled to the tray 36 such that the first divider 50, second divider 52, and cover 34 divide the enclosed space into a condensing side 54 and a cooling side 56.

The refrigeration system 32 includes a compressor 58, a condenser 60, a receiver 62, an expansion device (e.g., a thermostatic expansion valve, not shown), an evaporator 64 connected in series. The compressor 58, condenser 60, condenser fans (not shown), receiver 62, and controls 66 are disposed within the condensing side 54. The expansion device, evaporator 64, and evaporator fans 68 are located on the cooling side 56. The refrigeration system 32 also includes a cascading condensate tray 70 on the condensing side 54 adjacent the side perforations 44. The compressor 58, condenser fans, and evaporator fans 68 are controlled by the control 66 and operate using 120 Volt A/C power provided by a plug and cord 82 extending from the case 30 (See FIG. 1). The refrigeration system may include a temperature sensor (not shown) in the return air stream electronically coupled to the control 66 to cycle the compressor 58 on and off based upon the temperature sensed by the sensor to maintain a desired temperature of the products 16.

Figure 5:
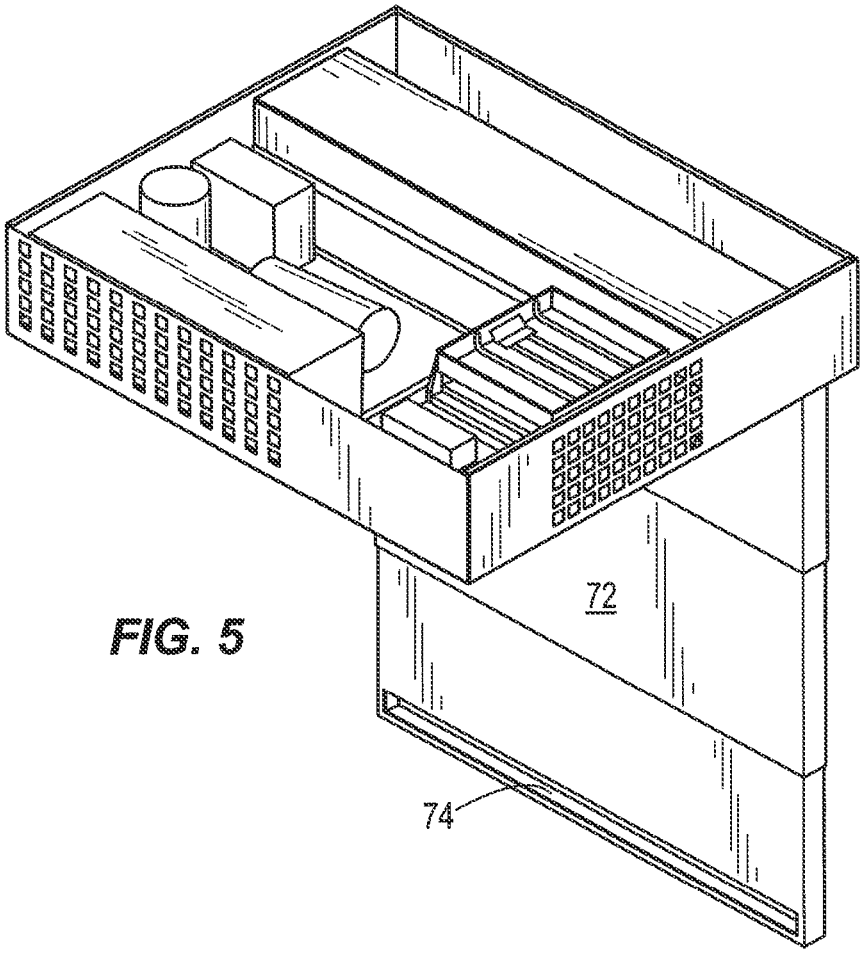
FIG. 5 is a perspective view of another construction of the portable refrigeration unit of FIG. 2 with the cover removed.
Figure 6:
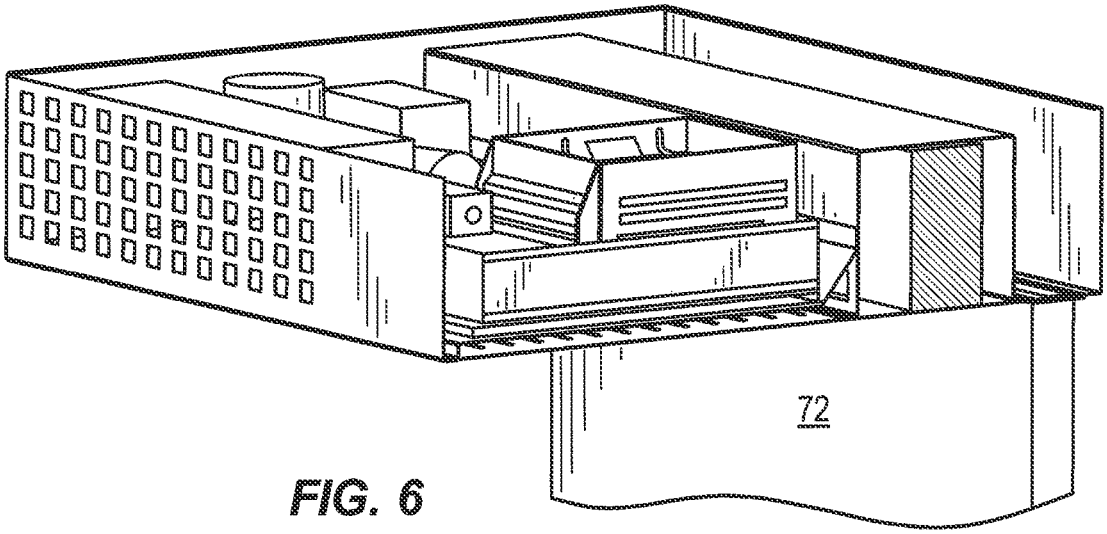
FIG. 6 is a cross-section view taken along line 6-6 in FIG. 5.
Figure 7:
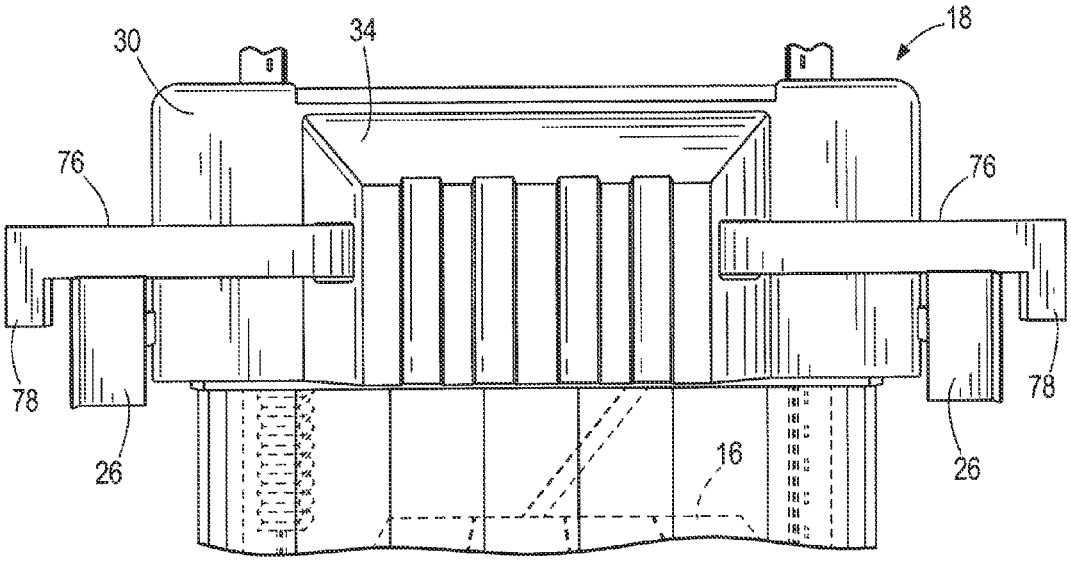
FIG. 7 is a side view of the portable refrigeration unit of FIG. 2.
Figure 8:
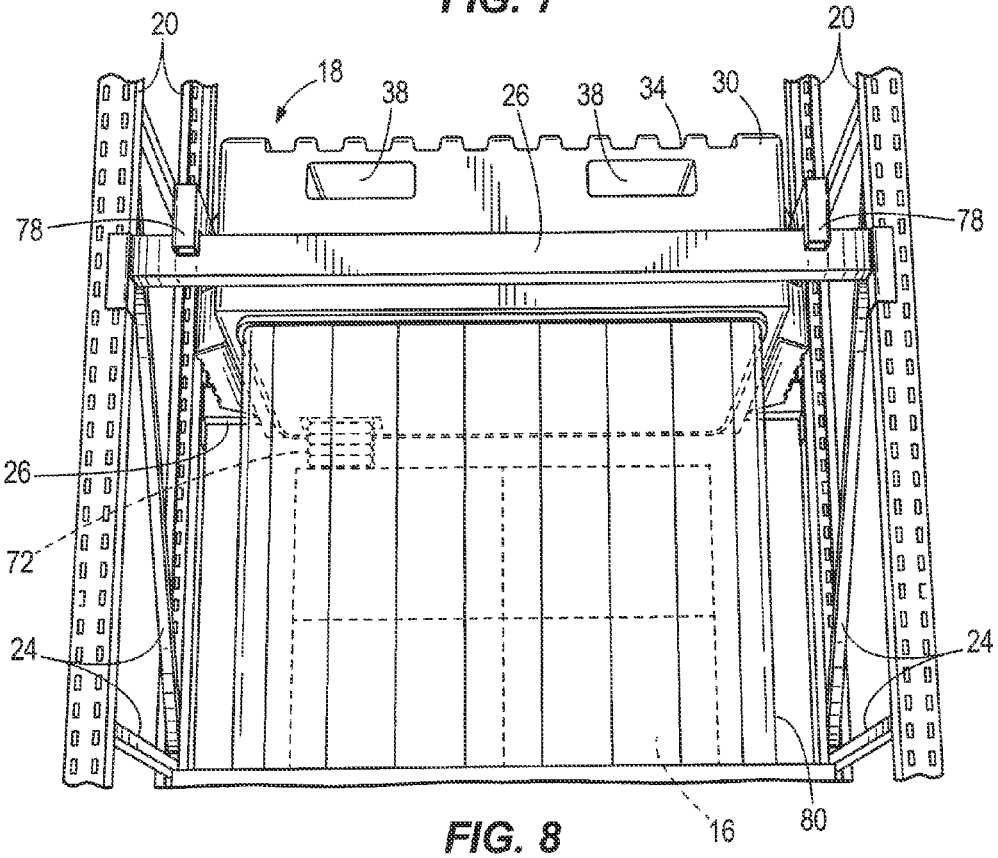
FIG. 8 is a perspective view of the portable refrigeration unit of FIG. 2 illustrating a curtain of the portable refrigeration unit.

The case 30 also includes an air return duct 72 that is attached at its top end to the tray 36 at the bottom aperture 48. The bottom end of the air return duct 72 includes a duct inlet 74. The duct 72 shown in FIGS. 5 and 6 is a telescoping duct that is extendable to the position shown and retractable to a position within the case 30. FIGS. 1, 2, 7, and 8 illustrate another construction of an extendable return duct 72, which extends using an accordion style configuration.

The portable refrigeration unit 18 also includes rails 76 that adjustably and slidably extend from the sides of the case 30 in the forward and rearward direction. In other constructions, the rails 76 can be fixed at a single position. The rails 76 are metal tubular structures that are generally rectangular in cross section. The end of each rail 76 includes a downwardly pointing hook portion 78.

The portable refrigeration unit 18 includes a polyethylene curtain 80 that is removably coupled by magnets to the bottom wall of the tray 36. The curtain 80 is slitted clear material allowing the products 16 inside of the curtain 80 to be seen and accessed by a person standing outside of the curtain 80. The curtain sections can also be configured to overlap with adjacent curtain sections to eliminate any gaps in the curtain 80.

The method of cooling palletized products 16 is described below with reference to FIG. 1. A pallet 14 of products 16 is positioned on the floor 22 within the racking system 12 by using a forklift. The forklift forks extend into the openings in the pallet apertures, and then the pallet 14 is lifted and moved into place. The pallet 14 is positioned in a sideways orientation such that the side of the pallet 14 is exposed to the open side of the racking system 12 facing the aisle. However, the pallet 14 could likewise be positioned in a front-to-back orientation.

After the pallet 14 of products 16 is in place, the horizontal supports 26 are adjusted to the desired height such that the portable refrigeration unit 18 is in close proximity to the top of the products 16 without interfering with the products 16. Then the forklift is used to lift the portable refrigeration unit 18 onto the horizontal supports 26. First, the rails 76 are moved to their retracted positions and the forklift forks are inserted into the apertures 38 in the front of the case 30. The forklift then lifts the case 30 into position above the pallet 14 of products 16 and above the horizontal supports 26. The rails 76 are then extended such that the hooked end portions 78 are positioned outside of the front and back horizontal supports 26. The forklift then lowers the portable refrigeration unit 18 until the rails 76 contact the horizontal supports 26 so that the portable refrigeration unit 18 is supported by the horizontal supports 26 and the racking system 12.

After the portable refrigeration unit 18 is supported above the pallet 14, the curtain 80 is magnetically attached to the bottom wall of the tray 36. The curtain 80 surrounds the product 16 on the pallet 14 and defines a product cooling zone within the curtain 80 and below the case 30. After the curtain 80 is in place, the plug 82 is inserted into a standard 120 Volt power outlet, and the refrigeration system 32 begins operation. Next, the return air duct 72 is extended downwardly to its fully extended position such that the inlet 74 is near the pallet 14.

When powered, the compressor 58 operates to compress a refrigerant and deliver the refrigerant to the condenser 60. The condenser fans force ambient air from outside the case 30 in though the perforations 40, 42 in the cover 34 and tray 36, and through the condenser 60 to cool the compressed vapor refrigerant passing through the condenser 60. As the air passes through the coil 60, the refrigerant cools and condenses into a liquid phase and the air is heated. The heated air passes through the condensing side 54 of the case 30 and passes over the condensate tray 70 to assist in removing any condensate that has been delivered from the evaporator coil 64. From there, the heated air continues through the side perforations 44 in the tray 36 and cover 34 to exit from the side of the case 30 into the ambient air surrounding the unit.

After the condensed refrigerant leaves the condenser 60, it enters the receiver 62 where any remaining vapor is separated such that only liquid is delivered to the expansion device where the refrigerant is metered to a lower pressure causing the liquid refrigerant to lower in temperature. Evaporator fans 68 draw air in from the return air duct 72 and force the air through the evaporator coil 64. As the air passes through the coil 64 and the refrigerant passes through the evaporator 64, the air transfers heat to the liquid refrigerant causing it to evaporate into a liquid and vapor phase. Thus, in turn, the air is cooled and then directed through an aperture 84 in the second divider 52 to enter a plenum 86 below the first divider 50. From the plenum 86, the cooled air is discharged through the perforations 46 in the bottom wall of the tray 36 such that the cooled air is evenly distributed over the products 16 positioned on the pallet 14 below. The liquid and vapor mixture continues to pass through the evaporator 64 and ultimately reaches a fully superheated vapor state at the evaporator outlet where it is sucked back into the compressor 58 to be circulated through the circuit again.

As shown in FIG. 1, an additional pallet of product can be stored on top of the portable refrigeration unit 18. The additional pallet of product will be stored only, and will not be cooled by the portable refrigeration unit. However, a second portable refrigeration unit could be positioned above the additional pallet of products to cool the products on the additional pallet in the same manner as the unit described above. Likewise, additional portable refrigeration units can be supported by the racking system 12 in a side-by-side manner to separate or commonly cool two side-by-side adjacent pallets of products.

Figure 9:
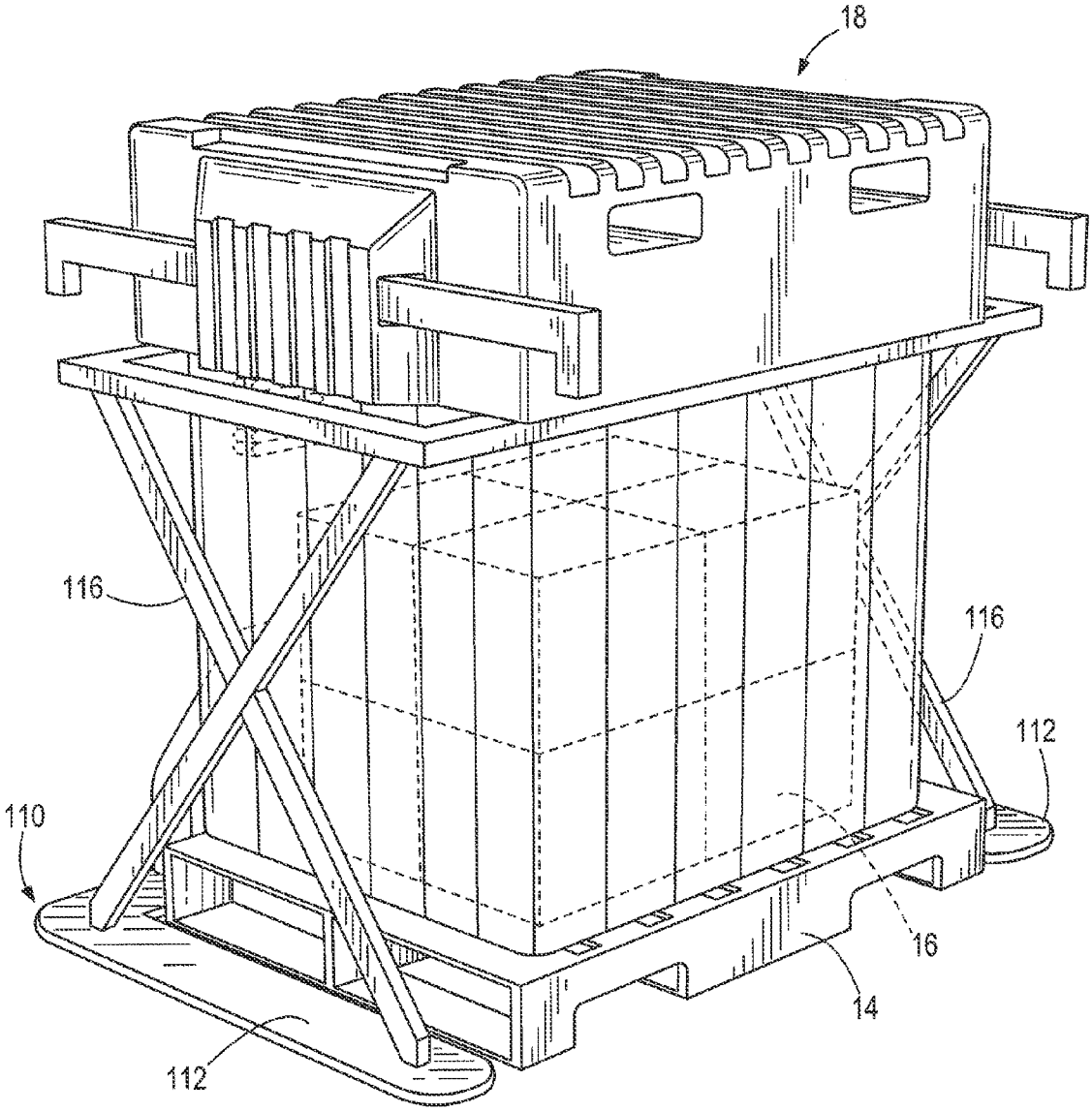
FIG. 9 is a front perspective view of another construction of the portable refrigeration system according to the invention.
Figure 10:
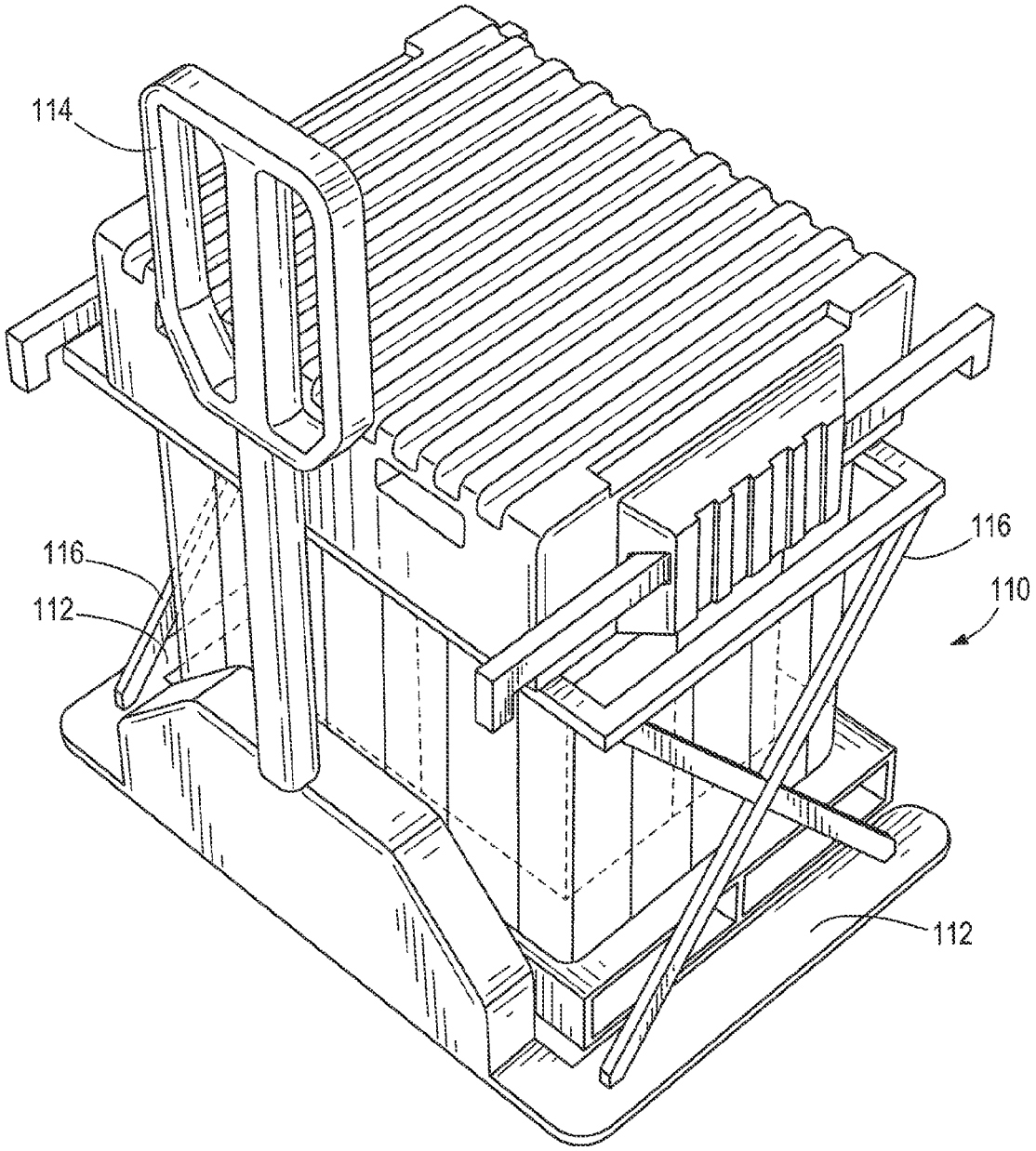
FIG. 10 is a rear perspective view of the portable refrigeration system of FIG. 9.

FIGS. 9 and 10 illustrate another construction of a racking system 110 configured to support the portable refrigeration unit 18. In this construction, the racking system 110 itself is portable such that it can be moved while supporting the portable refrigeration unit 18 to a pallet 14 that is positioned on the floor 22 but not surrounded by a racking system 12. The portable racking system 110 is built similar to a hand operated pallet jack in that it includes two forked blades 112 that include wheels (not shown) such that portable racking system 110 can be rolled along a floor 22 by pushing or pulling a handle 114. The portable racking system 110 includes a scissor-lift 116 (shown in simplified form in FIG. 9) that can raise or lower the refrigeration unit 18 supported on the racking system 110 by pumping the handle 114 to increase the hydraulic pressure to raise the scissor-lift 116 or by releasing a lever (not shown) within the handle 114 to decrease the hydraulic pressure to lower the scissor-lift 116.

To move the portable racking system 110 in position to cool products 16 on a free-standing pallet 14, the lever of the portable racking system 110 is actuated such that the hydraulic pressure of the scissor-lift 116 is released thereby moving the portable refrigeration unit 18 to the lowered position. Once in the lowered position, the portable racking system 110 and the portable refrigeration 18 unit are wheeled to a position adjacent the rearward side of the pallet 14 where the handle 114 is pumped to raise the scissor-lift 116 and the portable refrigeration unit 18 until the unit clears the top of the products 16 on the pallet 14. Then the portable racking system 110 is slowly and carefully moved into the position illustrated in FIGS. 9 and 10. The portable racking system 110 is then locked in position such that the wheels are no longer able to rotate. The portable refrigeration unit 18 can then be operated similar to the unit 18 on the stationary racking system 12 described above.

Figure 11:
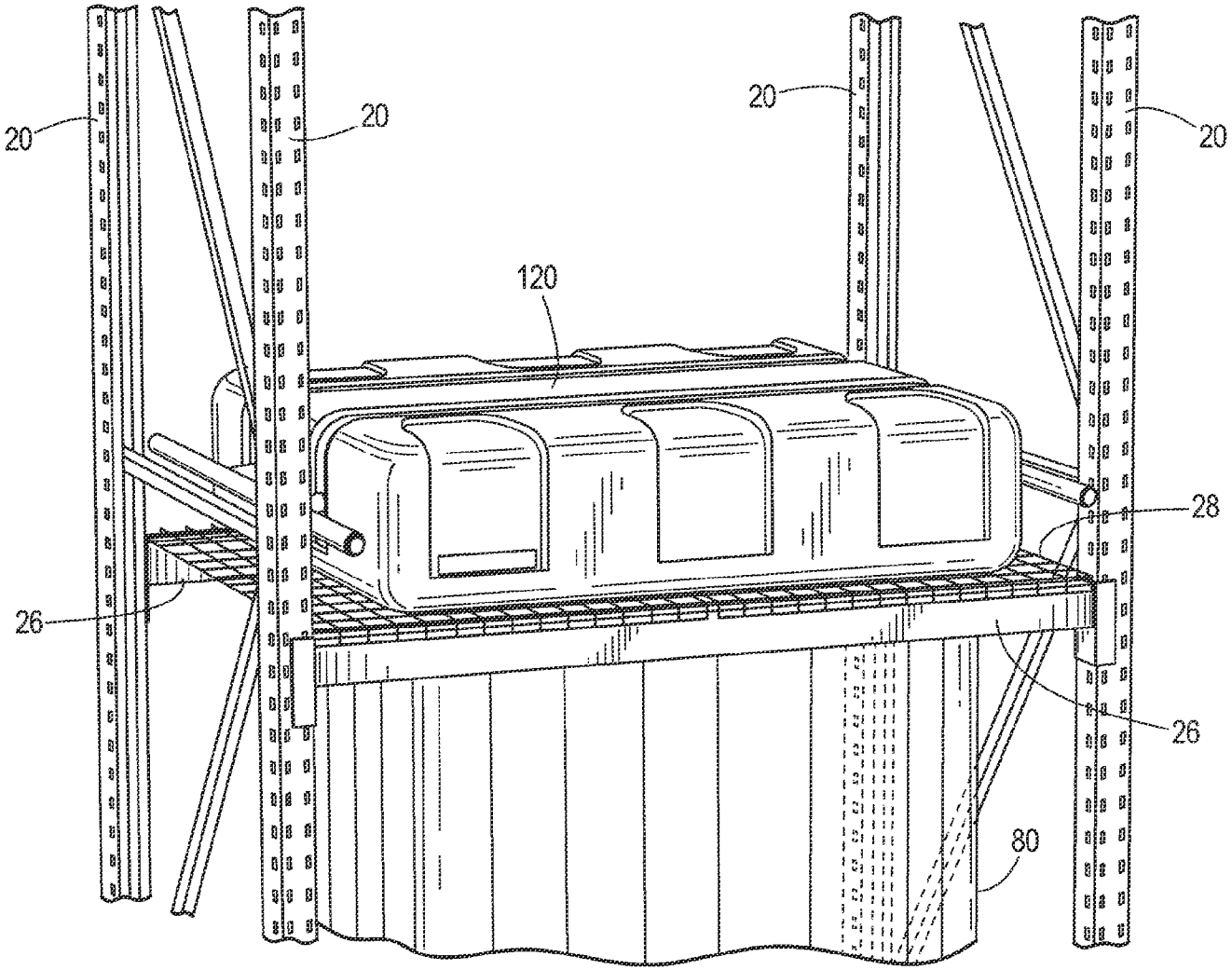
FIG. 11 is a perspective view of another construction of the portable refrigeration system according to the invention.

In other constructions, for example the one illustrated in FIG. 11, a portable refrigeration unit 120 can be supported on a wireframe shelf 28 of the racking assembly 12 and the curtain 80 can be removably coupled by magnets to the shelf 28. In this construction, the portable refrigeration unit 120 would not include an extendable return air duct, but rather would draw return air through the shelf 28 and into the bottom aperture 48 without any additional return air ducting. The portable refrigeration unit 120 is also different from the unit 18 in that unit 120 includes grab bars 122 for lifting the unit 120.

This invention provides a 120 volt plug-and-play portable refrigeration unit that can be used in any area of a store or warehouse which already has a storage racking structure in place. In some constructions, the invention uses the racking system already present to become the frame structure and support for the portable refrigeration unit. Alternatively, the invention utilizes a portable racking system.

Various features and advantages of the invention are set forth in the following claims.

What is claimed is:

1. A portable refrigeration unit for cooling palletized products disposed within a racking system, the portable refrigeration unit comprising:

a case including a bottom wall, a top wall, and side walls, the case configured to be supported by the racking system above a pallet of products positioned below the case;

rails extending from two sides of the case, each rail adjustably and slidably extensible to contact the racking system to support the case above the pallet of products, and each rail having a hook portion to engage the racking system;

a refrigeration system disposed within the case, the refrigeration system including a compressor, a condenser, an expansion device, and an evaporator connected in series, the refrigeration system includes an evaporator fan configured to draw in air from below the case, move the air through the evaporator, and then discharge the air through the bottom wall such that the cooled air passes over the products below the case to cool the products below the case; and a return duct coupled to the case and in fluid communication with the evaporator fan, the return duct extendable and retractable below the case between a first position and a second position, wherein the evaporator fan is configured to draw air from below the case through the return duct.

2. The portable refrigeration unit of claim 1, wherein the case includes a rigid casing including a ribbed top wall and rounded corners adjoining adjacent walls.

3. The portable refrigeration unit of claim 1, further comprising a curtain suspended below the case and configured to surround the product of products to define a product cooling area around the product.

4. The portable refrigeration unit of claim 3, wherein the curtain is segmented to allow access to the product from outside the curtain.

5. The portable refrigeration unit of claim 1, wherein the case includes apertures for receiving forks of a forklift, the case configured to be lifted by the forklift when the forks are positioned within the apertures.

6. The portable refrigeration unit of claim 1, wherein the return duct includes an inlet positioned adjacent the pallet of products when the return duct is extended from the first position to the second position.

7. The portable refrigeration unit of claim 1, wherein the air discharged through the bottom wall passes through perforations formed in the bottom wall such that the discharged air is evenly distributed over a top of the pallet of products.

8. The portable refrigeration unit of claim 1, wherein the return duct defines an airflow path that is substantially parallel to the air discharged through the bottom wall.

9. The portable refrigeration unit of claim 1, wherein the air duct is coupled to the bottom wall of the case adjacent a first side wall of the case, and wherein the air discharged through the bottom wall exits the refrigeration system adjacent a second side wall opposite the first side wall of the case.

10. A portable refrigeration system comprising:

a racking system supported on a floor;

a pallet of products to be cooled disposed within the racking system; and a portable refrigeration unit including a case including a bottom wall, a top wall, and side walls;

rails extending from two sides of the case, each rail adjustably and slidably extensible to contact the racking system to support the case above the pallet of products, and each rail having a hook portion to engage the racking system;

a refrigeration system disposed within the case, the refrigeration system including a compressor, a condenser, an expansion device, and an evaporator connected in series, the refrigeration system includes an evaporator fan configured to draw in air from below the case, move the air through the evaporator, and then discharge the air through the bottom wall such that the cooled air passes over the products below the case to cool the products; and a return duct coupled to the case and in fluid communication with the evaporator fan, the return duct extendable and retractable below the case between a first position and a second position, wherein the evaporator fan is configured to draw air from below the case through the return duct.

11. The portable refrigeration system of claim 10, wherein the case includes a rigid casing including a ribbed top wall and rounded corners adjoining adjacent walls.

12. The portable refrigeration system of claim 10, further comprising a curtain suspended below the case and configured to surround the product of products to define a product cooling area around the product.

13. The portable refrigeration system of claim 12, wherein the curtain is segmented to allow access to the product from outside the curtain.

14. The portable refrigeration system of claim 10, wherein the case includes apertures for receiving forks of a forklift, the case configured to be lifted by the forklift when the forks are positioned within the apertures.

15. The portable refrigeration unit of claim 10, wherein the return duct includes an inlet positioned adjacent the pallet of products when the return duct is extended from the first position to the second position.

16. A method of cooling palletized products disposed within a racking system, the method comprising:

providing a racking system;

supporting the racking system on a floor;

placing a pallet of product to be cooled on the floor within the racking system;

positioning a portable refrigeration unit above the pallet of product to be cooled;

supporting the portable refrigeration unit with the racking system via rails extending from two sides of a case of the portable refrigeration unit and having hook portions engageable with the racking system, wherein the supporting step includes extending the rails away from the case and hanging the rails onto the racking system;

extending a return duct from a first position to a second position below the case, the return duct in fluid communication with the portable refrigeration unit;

discharging cooled air from the portable refrigeration unit into a space below the portable refrigeration unit;

passing the cooled air over the products to cool the products; and returning at least a portion of the cooled air to the portable refrigeration unit from the space below the portable refrigeration unit via the return duct.

17. The method of claim 16, further comprising discharging cooled air from perforations distributed across a bottom wall of the portable refrigeration unit into a space below the portable refrigeration unit.

18. The method of claim 16, further comprising plugging the portable refrigeration unit into a 120 Volt A/C outlet.

19. The method of claim 16, further comprising positioning a curtain below the portable refrigeration unit and around the pallet.

20. The method of claim 19, further comprising magnetically attaching the curtain to the bottom of the portable refrigeration unit.

21. The method of claim 16, further comprising inserting forks of a forklift into the portable refrigeration unit, lifting the portable refrigeration unit above the pallet of products to be cooled, and removing the forks from the portable refrigeration unit after the portable refrigeration system is supported with racking system.

22. The method of claim 16, further comprising adjusting the height of the portable refrigeration unit on the racking system.

23. The method of claim 16, further comprising retracting the return duct from the second position to the first position.

* * * * *